United States Patent [19]

Church et al.

[11] Patent Number: 4,813,539

[45] Date of Patent: Mar. 21, 1989

[54] CARTON WITH CORE RETAINING PROJECTIONS

[75] Inventors: Thomas W. Church, Mason, Ohio; Jimmy J. Hanko, Lexington, Ky.

[73] Assignee: The Proctor & Gamble Company, Cincinnati, Ohio

[21] Appl. No.: 114,886

[22] Filed: Oct. 29, 1987

[51] Int. Cl.[4] ..... B65D 85/67; B65D 5/50

[52] U.S. Cl. ..... 206/396

[58] Field of Search ..... 206/396, 397, 398

[56] References Cited

U.S. PATENT DOCUMENTS

| | | | |
|---|---|---|---|
| 1,889,933 | 12/1932 | Pratt . | |
| 2,101,355 | 12/1937 | Wonder . | |
| 2,624,521 | 1/1953 | Broeren | 242/55.5 |
| 2,708,066 | 5/1955 | Caraher | 229/40 |
| 2,743,009 | 4/1956 | Williamson et al. . | |
| 2,803,339 | 8/1957 | Kuchenbecker . | |
| 2,860,773 | 11/1958 | Zackheim . | |
| 2,935,192 | 5/1960 | Million-Czarnecki . | |
| 3,229,812 | 1/1966 | Metzger . | |
| 3,246,742 | 4/1966 | Coe . | |
| 4,298,123 | 11/1981 | Roccaforte et al. | 206/396 |

*Primary Examiner*—William Price

*Attorney, Agent, or Firm*—Richard C. Witte; John V. Gorman

[57] ABSTRACT

A carton for a roll-type product which is dispensed by unrolling, withdrawing and separating a piece of the product from that remaining on the roll. The carton has a projection extending inwardly from each end wall, into the core of the product, to prevent the roll from being withdrawn from the carton during use. The end walls have an inner end flap with an orifice and an overlapping end flap with the projection hingedly attached to it and extending through the orifice. The projection has a central section which is generally triangular with the apex located distally of the hinge. Wing sections flank the central section and these are adapted to be folded back from the central section as the projection is inserted through the orifice, to form the projection into an open-sided generally pyramidal shape which is deflectable towards the product core following insertion.

16 Claims, 4 Drawing Sheets

Fig. 2
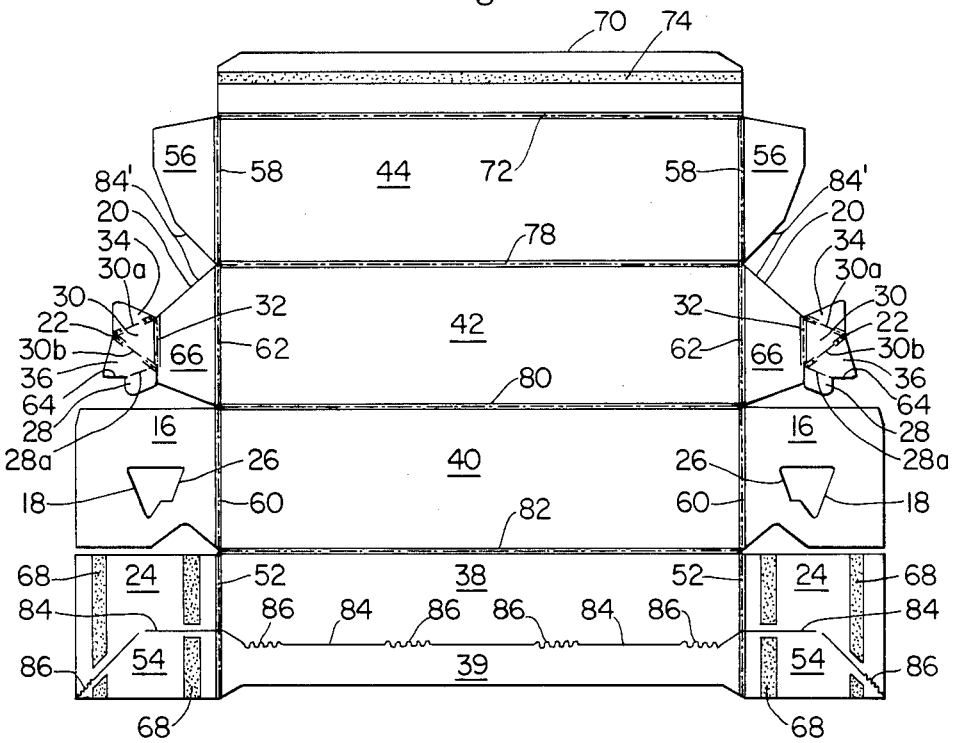
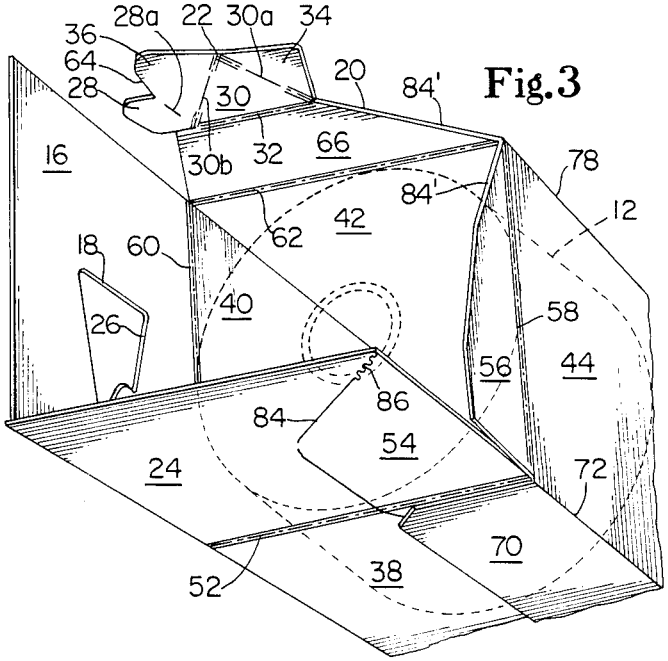
Fig. 3

CARTON WITH CORE RETAINING PROJECTIONS

TECHNICAL FIELD

This invention relates to cartons for roll-type products and, more particularly, for such products which are unrolled and withdrawn piecemeal from the carton.

BACKGROUND ART

Roccaforte et al U.S. Pat. No. 4,298,123, issued Nov. 3, 1981, relates to a core retainer carton for a product with a hollow core and which carton has an end wall which comprises an inner wall having an orifice therethrough with a slotted detent adjacent the orifice, and an overlapping wall having a projection thereon extending through the orifice into the core of the product. The projection forms a V-shaped insert pointing into the core. A locking tab on the outer end of the projection engages the slotted detent to lock the projection in the core.

Other patents which disclose the broad concept of a roll retention feature having the retention member formed as part of the carton and tucked inwardly into the roll core include: Pratt, U.S. Pat. No. 1,889,933, issued Dec. 6, 1932; Wonder, U.S. Pat. No. 2,101,355, issued Dec. 7, 1937; Broeren, U.S. Pat. No. 2,624,521, issued Jan. 6, 1953; Caraher, U.S. Pat. No. 2,708,066, issued May 10, 1955; Williamson et al, U.S. Pat. No. 2,743,009, issued Apr. 24, 1956; Kuchenbecker, U.S. Pat. No. 2,803,339, issued Aug. 20, 1957; Million-Czarnecki, U.S. Pat. No. 2,935,192, issued May 3, 1960; Metzger, U.S. Pat. No. 3,229,812, issued Jan. 18, 1966 and Coe, U.S. Pat. No. 3,246,742, issued Apr. 19, 1966.

There are problems associated with the constructions disclosed in the aforementioned patent. In some cases, the cartons are obviously very much more expensive than similar cartons without roll-retention means incorporated therein. In others, the cartons would require complex assembly equipment to erect and produce packed products automatically, necessitating delicate machine adjustments, slower packing speeds and lower efficiencies of operation. Typical are embodiments in which slight misalignment of the product with the carton can cause damage to the package and inefficient machine operation. In still other cases, the retention members are designed or formed in such a way as to interfere with rotary movement of the roll-type product carried by the carton, e.g. because of its shape or by reason of rigid raw (i.e. cut) edges of the retention members frictionally contacting the interior of the roll or, possibly, engaging projecting or unfettered parts of the core or product material and thereby unnecessarily increasing the effort required to dispense the product.

BRIEF SUMMARY OF THE INVENTION

It is an object of the present invention to obviate the above described problems.

It is another object of the present invention to provide a carton for a roll-type product in which a roll retaining projection is present at each end and wherein the carton is economical to produce and capable of being run on high speed forming, packing and sealing equipment.

It is a further object of the present invention to provide a roll-retaining projection at each end of a carton for roll-type products, each of which projections can be formed into three dimensional pyramidal shape by a machine finger moving axially inwardly and are deflectable sideways to avoid being damaged in the event said finger moves too deeply into the carton.

It is a still further object of the present invention to provide a roll-retaining carton using end projections which are generally pyramidal in shape and arranged to minimize problems due to misalignment of the product roll with the projections as they are being inserted.

In accordance with one aspect of the present invention, there is provided a carton containing a roll-type product having a central, axially-extending core, the carton having an end wall which includes an inwardly-folded inner end flap with an orifice therethrough. The inner end flap is attached to a first carton side wall. An overlapping inwardly folded end flap is attached to a second carton side wall and has a projection thereon which extends through the orifice into the core. The overlapping end flap includes a panel with one edge attached to the second carton side wall and the edge opposite the one edge connected along a hingeline to the projection. The projection has a central section, the proximal edge of which is defined at least in part by the hingeline and tapers to become narrower in the distal direction. A wing section is juxtaposed the central section along each of its lateral edges. A scoreline extends from each end of the proximal edge of the central section, to provide a foldline intermediate the lateral edges of the central section and the contiguous edges of the wing sections. The central section and wing sections of the projection are adapted to be formed into an open sided generally pyramidal shape, with the wing sections folded at an angle to the central section as the projection is inserted through the orifice. The projection is deflectable outwardly towards the core by rotating about the hingeline following insertion.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

FIG. 2 is a plan view of the interior surface of the blank for forming the carton of FIG. 1;

FIG. 3 is a partial perspective view of one end of the carton of FIGS. 1 and 2, taken from a vantage point below the carton and illustrating the orientation of the carton and the relationship of the carton end flaps following squaring of the tubular carton;

DETAILED DESCRIPTION OF THE INVENTION

Where products such as fabric softeners, waxed paper, aluminum foil, film wraps and the like are formed in a roll around a hollow core, it is advantageous to have some means for preventing the core with the product thereon from coming out of the box each time product is dispensed from the roll. Some of the prior art cartons have metal edge cutters on one edge of the carton. With those, the product is unrolled to the extent needed and then cut on the metal edge cutter. Alternately, with other types of cartons, no edge cutter is necessary. The product may simply be unrolled until a pre-determined perforated section is reached and then the product is torn loose at the perforations.

However, with such cartons, when the product is unrolled or a section is attempted to be removed, frequently the entire roll comes out of the package, interfering with the dispensing and necessitating rewinding and reinstallation of the product. The problem of roll displacement is also experienced when a carton is dropped or, sometimes, when the package is merely being handled. The inventions of the aforesaid Roccaforte et al patent and of others are directed toward the provision of some type of projection inserted into the hollow core of the product roll and attached to the carton itself to prevent the roll from coming out of the box when the product is unrolled. The present invention overcomes the disadvantages of such prior art solutions by providing a special form of projection integrally formed with the carton blank such that when the blank is folded to form the carton, filled and sealed, a pyramidally shaped projection is inserted inside the hollow core of the product roll and prevents the roll from being removed inadvertently from the carton by dispensing or unrolling product from the product roll.

Figure 1:
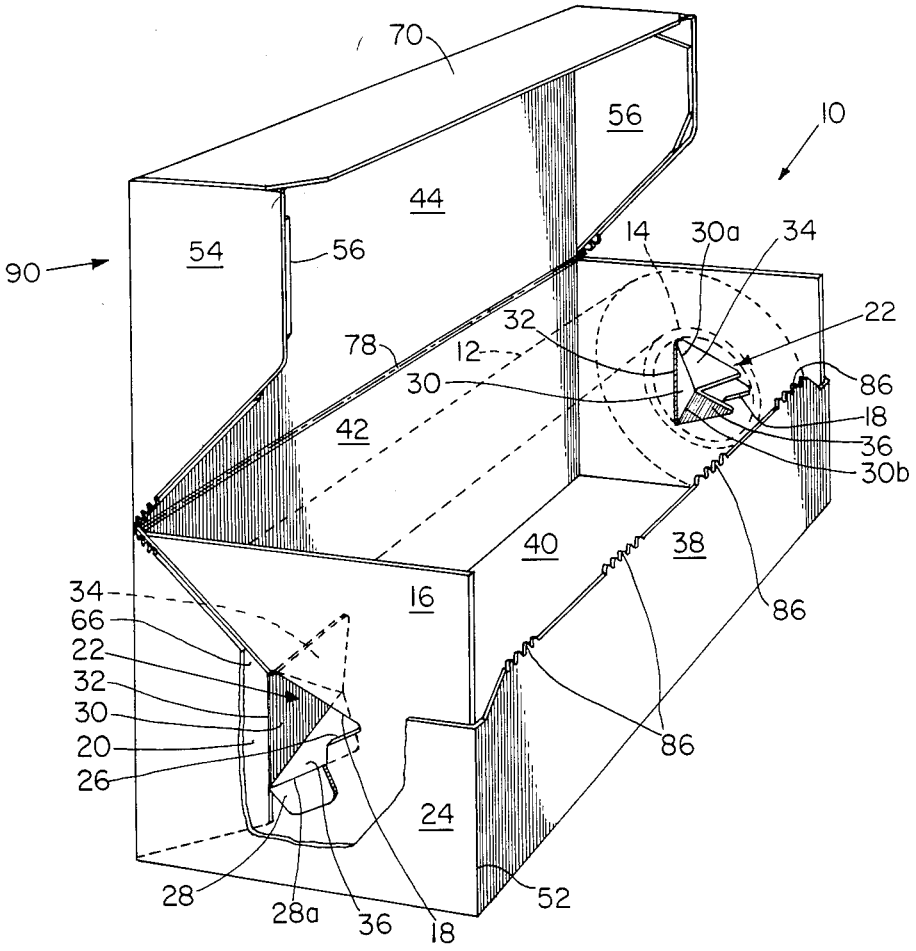
FIG. 1 is a perspective view, partially broken away for clarity, of one embodiment of a carton of the present invention showing the carton in its opened state, with a product roll on a hollow core illustrated in phantom.

Referring now to the drawings in detail, wherein like numerals indicate the same element throughout the views, a carton is presented which is essentially an improvement to the above-identified Roccaforte et al patent. As seen in FIG. 1 there is provided a novel end wall construction used to retain a roll-form product in the carton as the product is dispensed. Carton 10 is of rectangular cross section and has therein product roll 12 which is formed or rolled on hollow core 14. The end wall construction of carton 10 comprises an inner wall 16 having an orifice 18 therein, an overlapping wall 20 having a projection 22 thereon and an outer wall 24 for sealing the end of the carton. Inner wall 16 has a detent 26 formed on one side of orifice in which a locking tab 28 of projection 22 may be inserted to hold projection 22 in place inside hollow core 14.

Projection 22 at each end is coupled to panel 66 along a hingeline formed at score or foldline 32. A central section 30 has a proximal edge defined at least in part by score 32. The central section 30 is tapered narrower in its distal direction, forming a triangular shape with its apex extending away from foldline 32. Wing sections 34, 36 are juxtaposed central section 30 along each of its lateral edges, scorelines **30*a* and 30*b* providing foldlines intermediate the lateral edges of central section 30 and the contiguous edges of the wing sections 34, 36. Scorelines 30*a* and 30*b* extend from each end of the proximal edge of central section 30, which in the illustrated embodiment are coincident with the ends of foldline 32. A locking tab 28 hingedly connected at scoreline 28*a* to a side edge of wing section 36 is engaged with the detent 26 at orifice 18 in inner wall 16, thereby locking the projection 22 within the hollow core 14**.

As can be seen in FIG. 1, if any pressure is applied to product roll 12 and its associated hollow core 14, such as by attempting to dispense product from roll 12, projection 22, inserted within hollow core 14, tends to retain core 14 within the carton and prevent it from being dislodged. The manner in which the inner wall 16, overlapping wall 20 and outer wall 24 are attached to the carton sides will be shown hereinafter.

A blank for forming the illustrated carton embodiment is disclosed in FIG. 2. Front side wall 38, bottom side wall 40, back side wall 42 and top side wall 44 are integrally formed and hingedly connected to each other by means of score lines 82, 80 and 78, respectively. Also integrally formed with and hingedly attached to the outer edge of top side wall 44 by means of score line 72 is an extension panel 70. The interior surface of extension panel 70 has a glue strip 74 formed thereon for fastening said extension 70 to the front side wall 38 of said carton when the carton is tubed.

Bottom side wall 40 of the carton has integrally formed with and hingedly attached to each end thereof by scorelines 60, the inner wall 16. Inner wall 16 has therein orifice 18 which has detent 26 formed in one side which is similar in shape to the central section 30, but sightly larger in dimension.

Back side wall 42 has integrally formed therewith and hingedly attached to each end thereof, by means of scorelines 62, the overlapping wall 20 which includes panel 66 and the projection 22, previously described in its erected form.

Flap 56 is integrally formed with and hingedly attached to top side wall 44 by means of scoreline 58. The adjacent slanted edges 84' of flap 56 and panel 66 of overlapping wall 20 are designed so that the angles they form with scorelines 58–62 are complementary to one another.

Front side wall 38 has outer wall 24 integrally formed therewith and attached at each end by scorelines 52. The outer walls 24 and front side wall 38 are divisible into two portions each, with outer wall portions 54 and front side wall portion 39 being separable from the remaining portions of outer walls 24 and front side wall 38 along a line of weakness comprising alternating cuts or slits 84 and tear strips 86. Two spaced glue strips 68 are provided on the interior outer walls 24 generally parallel to scorelines 52 at the time the carton is erected, filled and sealed. These are arranged to ultimately adhesively secure outer wall 24 to portions of inner wall 16 and panel 66 when the carton is in the erected, filled and sealed condition shown in FIG. 6. Preferably one of the glue strips 68 also adhesively secures locking tab 28 when the carton is in such condition.

The blank of FIG. 2 is tubed, i.e. placed in flattened tubular form, by folding front side wall 38 180° upwardly about scoreline 82 and then folding top side wall 44 and extension 70 upwardly 180° about scoreline 78 thereby adhesively securing the inner surface of extension 70 to the outer surface of front side wall portion 39 by means of adhesive strip 74.

Figure 4:
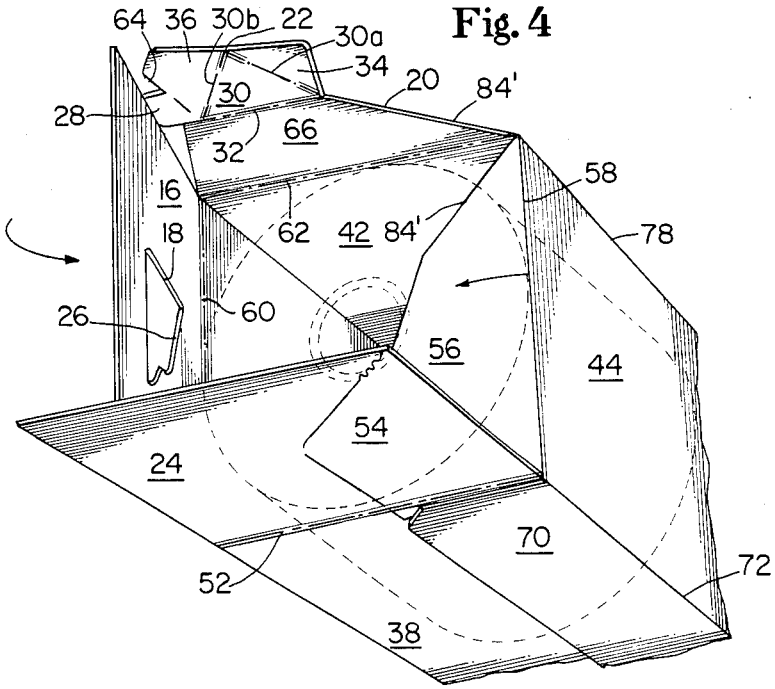
FIG. 4 is a partial perspective view similar to that of FIG. 3, as the carton end flaps are being folded.
Figure 5:
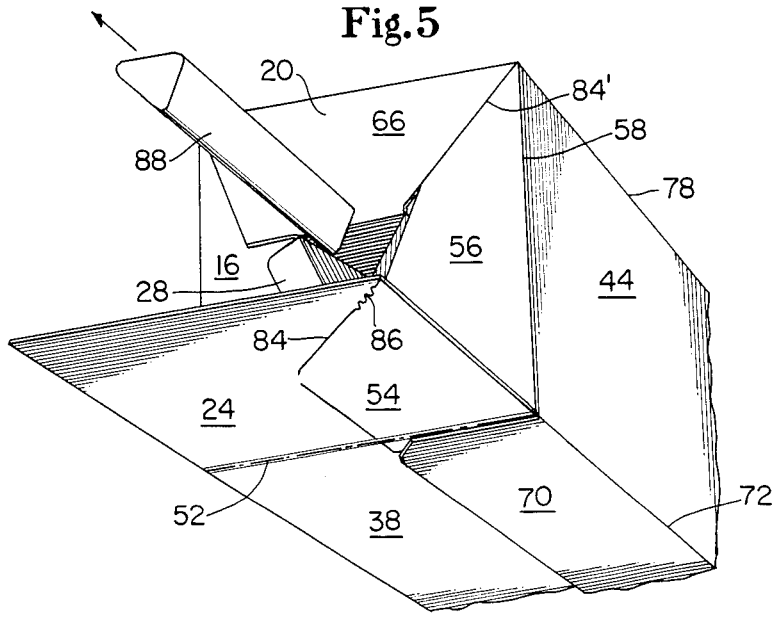
FIG. 5 is a partial perspective view similar to that of FIGS. 3 and 4, illustrating schematically the manner in which the projections embodying the present invention can be inserted following filling of the carton with the roll-formed product.

Referring to FIGS. 3, 4 and 5, the carton 10 is depicted in various stages of filling and sealing. FIG. 3 shows the carton 10 following erection, squaring, and loading (filling) with product roll 12. The carton, it will be noted, is oriented with front side wall 38 facing downwardly, thereby placing back side wall 42 on top. Next, as illustrated in FIGS. 4 and 5, inner walls 16 are folded inwardly, following which flaps 56 and overlapping walls 20 are also folded inwardly, over inner walls 16, in whatever order desired.

At this point the apex of central section 30 of the projection 22 of overlapping wall 20 points downwardly and is slightly higher than, but vertically aligned with, the similarly shaped apex of orifice 18 and the lowermost point on the inside diameter or surface of hollow core 14. Then a machine element 88, schematically represented as a finger having a cross section similar to that of central section 30, moves horizontally, inwardly of carton 10 at each end. The machine element 88 contacts central section 30, preferably initially at the apex and then gradually across progressively higher portions of the central section as the projection 22 is forced through orifice 18.

As the projection 22 moves inwardly at each end, the wing sections 34, 36 are folded outwardly along foldlines 30*a* and 30*b*. Thus, as the projections proceed through orifice 18 into the interior of hollow core 14, it is of open-sided, generally pyramidal shape, with the wing sections 34, 36 folded at an angle to the central section 30. The machine element 88 moves the projection 22 inwardly sufficiently for the outermost ends of folded wing sections 34, 36 to be moved just beyond the inner surface of inner wall 16. At such time the locking tab 28 has snapped into detent 26 and the wing section 34 springs open until the inner surface of the hollow core is contacted, both of which events occur because of inherent resilience of the carton 10 material. This is designed to happen just prior to a point in the tucking cycle at which the inner end of the machine element 88 starts to move beyond the then innermost ends of central section 30 and wing sections 34, 36. The projection 22 is then deflected outwardly toward the hollow core 14 by forces exerted by the sides of the machine element 88 on the inner surface of the projection, rotating about foldline 32, as the machine element continues its inward travel. The relative dimensions of projection 22 and the machine element 88 should be such that the locking tab is not swung out of the detent 26. Thus, the extent of the inward thrust of machine element 88 is not critical so long as the inner ends thereof do not make contact.

Figure 6:
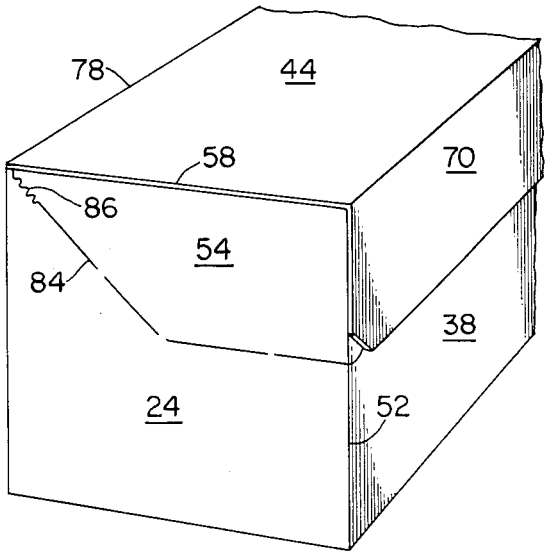
FIG. 6 is a partial perspective view of the carton of FIGS. 1–5; illustrating the carton following filling and sealing and with its orientation changed to that employed for use.

Subsequent to withdrawal of machine element 88 from carton 10, as shown in FIG. 5, tabs 28 are folded inwardly to contact the outer surfaces of inner walls 16, outer walls 24, with the adhesive strips 68 applied, are folded inwardly to adhesively seal each end of carton 10, resulting in the package illustrated in FIG. 6.

The package illustrated in FIG. 6 can be opened by applying inward pressure on front side wall 38 adjacent tear strips 86 to separate front side wall portion 39 from the balance of front side wall 38. Then the lower edge of adhesively united front side wall portion 39 and overlying extension 70 is lifted, causing the tear strips 86 on outer wall 24 to fracture, thereby forming the lid 90 hinged along score or fold line 78, the top edge of back side wall 42. At this point, the carton 10 is open and the product roll is accessible to the user.

For the described embodiment, the product roll 12 should be inserted so that the product moves upwardly along the interior of front side wall 38 as it is withdrawn from the carton because opposite orientation of the product roll 12, i.e. where the product moves upwardly along the inside of back side wall 42 makes it difficult to break the product along transverse perforations without exerting considerable pressure on the sides of the carton, as consumer would normally use it. With the product moving upwardly on the interior front side wall 38, the leading sheet can be reversed 180° and pulled down the outside of front side wall 38 so that the perforations will easily be broken when the top edge of front side wall 38 is traversed. Excessive pressure on the sides of carton 10 can cause the product roll 12 to bind at such top edge and/or on the projections 22. However, if a different type of lid arrangement was used with a package having ends formed in a manner similar to that described above, with projections 22 oriented as described, the lid could be mounted to the side wall opposite to the side wall from which overlapping wall 20 extends. In such case, then, the product roll 12 should be inserted so that it moves upwardly along the interior of the side wall from which overlapping wall 20 extends, for like reasons.

Because of the generally pyramidal shape of projections 22, the product roll 12 tends to be centered within the carton 10. This helps to prevent binding of product roll 12 while concurrently presenting a structure which retains the product roll in the carton while dispensing.

In addition, the tapered shape of the central section 30 enables the projection 22 to be inserted through orifice 18 with greater tolerance to its alignment with the hollow core 14 than would be the case if central section 30 was rectangular. In this connection, the insertion should begin with the distal ends of the projection adjacent the inner surface of the hollow core 14, for backup purposes. Where the central section 30 is triangular, the apex can be made to extend downwardly, aligned with and slightly higher than the lowermost point on the inside surface of hollow core 14. Since the product roll 12 diameter is substantially constant, gravity easily promotes fairly uniform elevation of such point; however, the lateral position of the point is subject to a certain amount of variation during the packaging operations.

As viewed from the side, with the described embodiment, the product roll 12 could shift an amount equal to the length of a horizontal chord which extends across the hollow core 14 interior and intersects the apex of central section 30, without causing interference between the apex and hollow core 14. Substantially the same benefit can be achieved if the central section 30 is made trapezoidal in shape, for example, if the distal base of the trapezoid has a length which is less than about 25% of the inside diameter of hollow core 14.

On the other hand, the amount of permissible variation of the horizontal position of product roll 12 would be substantially diminished if the central section 30 was made generally rectangular, for example, since the ends of the distal edge thereof would each be targeted to be adjacent the hollow core 14, for backup purposes, at higher elevations on the core. This would mean that less variation of horizontal roll position would cause interference and consequent damage to the package, tending to reduce manufacturing efficiencies because of sensitivity to roll position.

The projection 22 and orifice 18 should be properly sized relative the inside diameter of hollow core 14 in order to provide the best performance in use. Preferably, it should be sized so that a circle circumscribing the edges of the base of the projection 22, as the same is inserted through orifice 18, has a diameter which is in the range of from about 60% to about 90%, most preferably about 75% to about 85%, of the inside diameter of hollow core 14. For example, it has been found satisfactory for the circumscribing circle to have a diameter of approximately 2.54 cm (1 inch) when the inside diameter of hollow core 14 is about 3.17 cm (1.25 inches).

Many modifications of the above invention may be used and it is not intended to hereby limit it to the particular embodiments shown or described. The terms used in describing the invention are used in their descriptive sense and not as terms of limitation, it being intended that all equivalents thereof be included within the scope of the appended claims.

What is claimed is:

1. In a carton of rectangular cross section containing a product wound in roll form and adapted to be unrolled to withdraw and use, said wound product having a central, axially-extending core, the carton having an end wall which includes an inwardly-folded inner end flap with an orifice therethrough, said inner end flap being attached to a first carton side wall, and an overlapping inwardly-folded end flap attached to a second carton side wall, said overlapping end flap having a project thereon extending through said orifice into said core, the overlapping end flap including a panel with one edge attached to the second carton side wall and another edge connected along a hingeline to said projection, the improvement which comprises:

(a) said projection having a central section, the proximal edge of which is defined at least in part by said hingeline, said central section being tapered narrower in the distal direction, (b) a wing section juxtaposed said central section along each of the lateral edges thereof; and (c) a scoreline extending from each end of said proximal edge to provide a foldline intermediate said lateral edges and the contiguous edges of said wing sections;

(d) said central section and said wing sections of the projection being adapted to be formed into an opensided generally pyramidal shape with said wing sections folded at an angle to said central section as the projection is inserted through said orifice, said projection being deflectable outwardly towards said core by rotating about said hingeline following insertion.

2. The carton of claim 1 in which the central section is triangular in shape.

3. The carton of claim 1 in which the central section is a trapezoid and the distal base thereof has a length which is less than about 25% of the inside diameter of the core.

4. The carton of claim 1 in which the orifice in the inner end flap has a tapered shape similar to that of said central section whereby to coact with the contiguous edges of said wing sections as the projection is inserted through the orifice and form the generally pyramidal shape.

5. The carton of claims 1, 2, 3 or 4 in which said hingeline is generally parallel to the plane of said second carton side wall.

6. The carton of claim 5 in which the carton, when opened, has a lid articulated from one side of said second carton side wall and the roll is oriented so that product will be withdrawn from the side of the roll adjacent the side wall of the carton opposite said second carton side wall.

7. The carton of claim 5 in which the carton when opened, has a lid articulated from one side of the side wall of the carton opposite said second carton side wall and the roll is oriented so that product will be withdrawn from the side of the roll adjacent said second carton side wall.

8. The carton of claim 1 in which said orifice includes a detent on one side thereof and said projection has a locking tab extending from the side of a wing section opposite its said contiguous edge and adapted to engage with said detent to lock said projection in said core.

9. The carton of claim 8 in which an outer inwardly-folded end flap is attached to a third side of the carton and adhesively united with said panel, said inner end flap and said locking tab.

10. The carton of claim 9 in which said third side of the carton is opposite said second side wall.

11. The carton of claims 1, 2, 3, 4, 8, 9 or 10 in which a circle circumscribing the edges of the base of said generally pyramidally shaped projection as it is inserted through said orifice has a diameter which is in the range of about 60% to about 90% of the inside diameter of the core.

12. The carton of claim 11 in which the diameter of the circumscribing circle is in the range of from about 75% to about 85% of the inside diameter of the core.

13. The carton of claim 5 in which a circle circumscribing the edges of the base of said generally pyramidally shaped projection as it is inserted through said orifice has a diameter which is in the range of about 60% to about 90% of the inside diameter of the core.

14. The carton of claim 13 in which the diameter of the circumscribing circle is in the range of from about 75% to about 85% of the inside diameter of the core.

15. The carton of claim 13 in which the carton, when opened, has a lid articulated from one side of said second carton side wall, and the roll is oriented so that product will be withdrawn from the side of the roll adjacent the side wall of the carton opposite said second carton side wall.

16. The carton of claim 13 in which the carton, when opened, has a lid articulated from one side of the side wall of the carton opposite said second carton side wall and the roll is oriented so that product will be withdrawn from the side of the roll adjacent said second carton side wall.

* * * * *